US008739810B2

(12) United States Patent
Hoeptner

(10) Patent No.: US 8,739,810 B2
(45) Date of Patent: Jun. 3, 2014

(54) TUBULAR PLASTIC HYDRANT

(76) Inventor: Herbert W. Hoeptner, Gilroy, CA (US)

( * ) Notice: Subject to any disclaimer, the term of this patent is extended or adjusted under 35 U.S.C. 154(b) by 0 days.

(21) Appl. No.: 13/506,535

(22) Filed: Apr. 26, 2012

(65) Prior Publication Data

US 2013/0284280 A1 Oct. 31, 2013

(51) Int. Cl.

| | |
|---|---|
| ***E03B 7/10*** | (2006.01) |
| ***E03B 7/12*** | (2006.01) |
| ***E03B 9/02*** | (2006.01) |

(52) U.S. Cl.
USPC ..... 137/59; 137/302; 137/360

(58) Field of Classification Search
USPC ..... 137/360, 301, 302, 59, 60, 61
See application file for complete search history.

(56) References Cited

U.S. PATENT DOCUMENTS

| | | | | |
|---|---|---|---|---|
| 5,029,603 | A * | 7/1991 | Ackroyd | 137/218 |
| 5,590,679 | A | 1/1997 | Almasy et al. | |
| 5,752,542 | A * | 5/1998 | Hoeptner, III | 137/218 |
| 6,769,446 | B1 | 8/2004 | Ball et al. | |
| 6,805,154 | B1 | 10/2004 | Dickey et al. | |
| 6,830,063 | B1 | 12/2004 | Ball | |
| 6,883,534 | B2 | 4/2005 | Ball et al. | |
| 2010/0229961 | A1 * | 9/2010 | Ball et al. | 137/299 |

* cited by examiner

*Primary Examiner* — John Rivell
*Assistant Examiner* — Kevin Barss
(74) *Attorney, Agent, or Firm* — William W. Haefliger

(57) ABSTRACT

In a hydrant assembly, the combination comprising an outer tubular member having a first flow port.; an inner tubular member having a closure thereon to close the port in relatively axially advanced position of the closure, and to open the port in relatively axially retracted position of the closure that allows fluid flow through the port to an outlet, control means to control relative movement of the inner and outer members. A second port may be located sidewardly of the outer tubular member to pass fluid in relatively retracted position of the closure to relieve fluid pressure in space formed between the inner and outer members, the inner member being elongated and extending lengthwise in the outer tubular member. The outer tubular member may consist of plastic material. Travel of the closure acts to allow expansion of fluid as it freezes, to relieve pressure build-up within the assembly.

11 Claims, 2 Drawing Sheets

TUBULAR PLASTIC HYDRANT

BACKGROUND OF THE INVENTION

This invention relates generally to valves usable to deliver water from housing or building plumbing lines. More particularly, it concerns improvements to such valves, simplifying their construction, and enhancing their performance.

There is need in such valves for improvements associated with blocking, or checking, back-flow where reverse flow pressure may build up. Also, there is need in such valves for disposing of built-up back flow pressure, as during checking or blocking of such back flow to the building plumbing. Such back flow, if unchecked, could contaminate water in that plumbing.

Existing hydrants rely on a plunger to engage a seat, to limit flow, by spring force alone. If the spring force is too strong it restricts flow; and if the spring force is too weak, or if the plunger is corroded into the housing, it will not or may not properly shut off on the seat. If the plunger does not effectively shut off on the seat (to act as a check valve), it will not prevent backflow, backsiphonage or relieve backpressure. Build-up of backpressure would or could disrupt use of a plastic hydrant outer tube or body. Also, existing hydrants might pass the ASSE 1019 requirements when new, but would likely fail the requirements after a short period of "infield use". After three years it was found in a survey that about 68% of such hydrants failed to pass the ASSE 1019 tests.

There is need for improvements in hydrants as provided by the present invention; and wherein one or both of elongated outer and inner tubular body members consist of pressure expansible plastic material, in compact configuration, and are characterized by high reliability, absence of bore corrosion, and ease of installation and operation, and wherein an annular seal extends about an axis defined by a closure member, there being an axially elongated bore defined by the outer member, and into which the seal has sliding sealing fit as the inner member is advanced. There is particular need for improvements in hydrants that provide protection against freeze conditions.

SUMMARY OF THE INVENTION

It is a major object of the invention to provide an improved, compact, simple, highly effective back flow preventing valving assembly, meeting the above need. Basically the assembly includes a) an outer tubular member having a first flow port, b) an inner member having closure means thereon to close said port in relatively axially advanced position of said closure means, and to open said port in relatively axially retracted position of said closure means, c) control means to control relative movement of the inner and outer members, d) a second port located sidewardly of said outer tubular member to pass fluid from space between said members to relieve fluid pressure build-up under freeze conditions.

Added objects include provision of the closure means to comprise an annular seal extending about an axis defined by said closure member, there being an axially elongated bore defined by said outer member, and into which said seal has sliding sealing fit as the closure is advanced; a hollow valve body carrying said members; and an adjustment handle carried by said body to adjust the inner member between relatively advanced and retracted positions. As will be seen, the hollow valve body is typically metallic, and endwise supports the outer tubular member.

Another object includes location of the outer member to extend endwise between the handle, typically metallic, and relatively slidable sealing elements, in such manner as to provide added benefits.

Yet another object includes provision for redundant or multiple redundant relieving of excess pressures, as during freeze conditions.

Another object of this invention is to provide a wall hydrant which has the ability to drain at least some of the residual water when, under freezing conditions, residual water freezes because of a hose or the like being attached to the discharge nozzle.

It is a further object to provide a relief valve for the captured residual water to escape back towards the supply of pressurized water when the frozen water in the exterior of the hydrant creates excessive pressure on the remainder of the residual water in the hydrant.

These and other objects and advantages of the invention, as well as the details of an illustrative embodiment, will be more fully understood from the following specification and drawings, in which:

DRAWING DESCRIPTION

DETAILED DESCRIPTION

Figure 1:
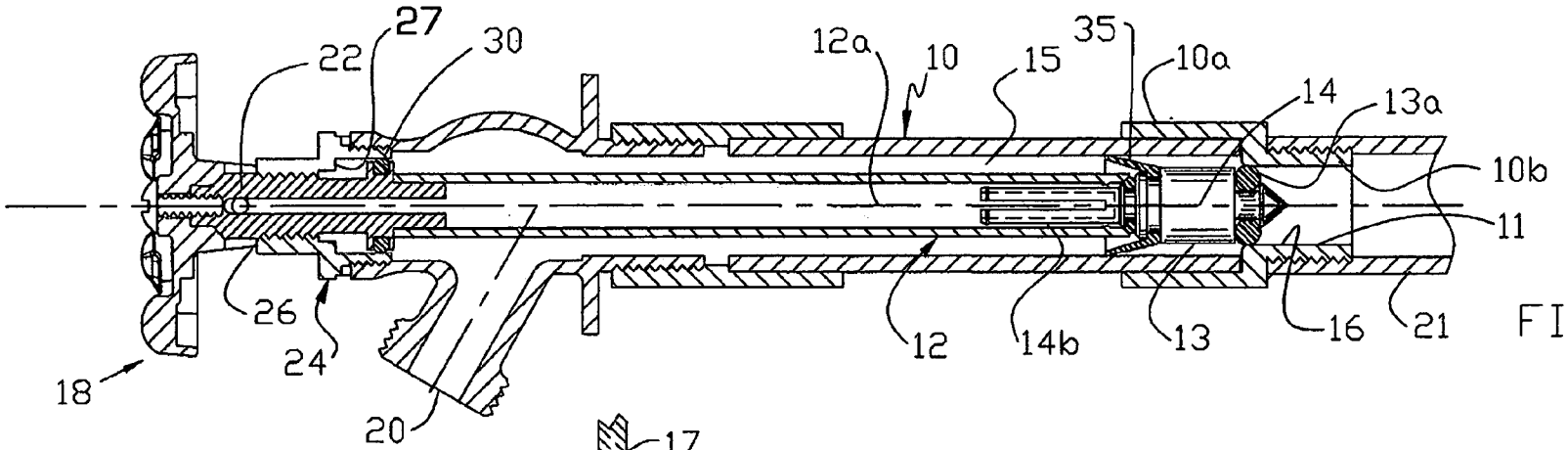
FIG. 1 shows hydrant structure in flow "OFF" or blocking position.
Figure 2:
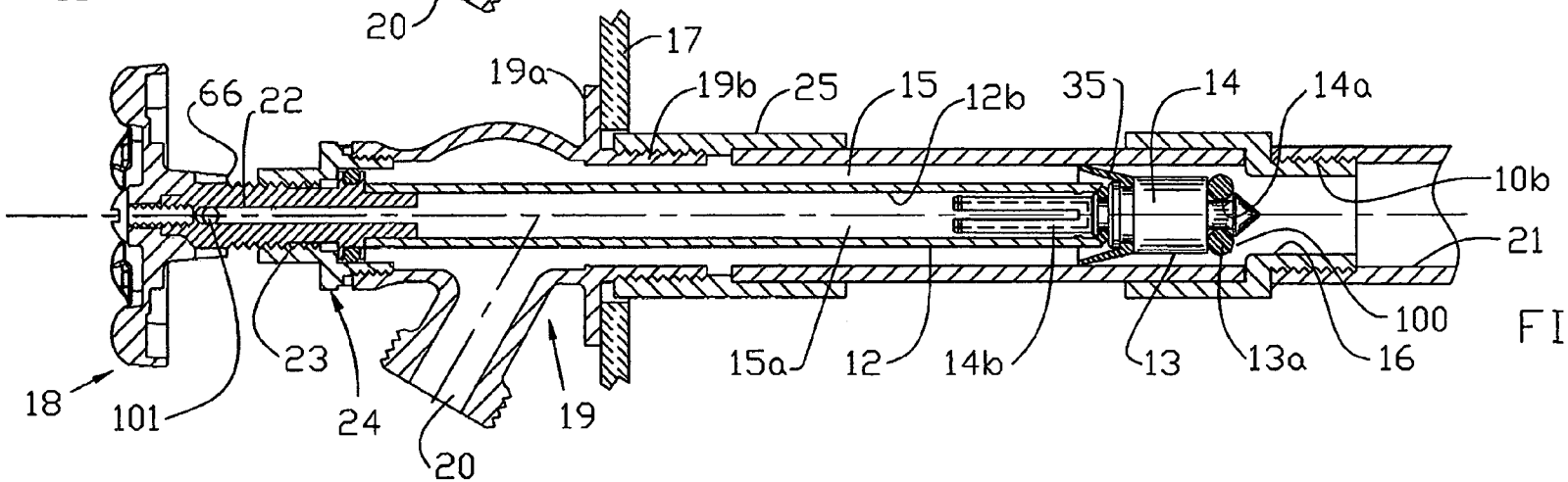
FIG. 2 is like FIG. 1, but shows the structure in flow "ON" or unblocked position.

In FIGS. 1 and 2, an outer tubular member 10, typically consists of metal or synthetic resinous or plastic material, and includes interfitting sub-members 10*a* and 10*b*. A first flow port 11 is provided and is typically cylindrical. An inner tubular member 12 is also provided to extend coaxially with 10, as respects longitudinal axis 12*a*. Member 12 also and typically may consist of metal or plastic material. An annular check member 35 permits fluid flow towards outlet tubing 20 and blocks fluid flow into port 11. Of added importance is the ability of check member 35. to seal during icy fluid conditions. Closure means 13, at the end of 12, serves to close port 11 in relatively axially advanced position of the closure means 13, as shown in FIG. 1; and to open port 11 in relatively axially retracted position of the means 13 as shown in FIG. 2. The closure means 13 typically includes an elastomeric O-ring 13*a* fitting about stem 14*a* of a plug or "bullet" body 14, there being a body extension or stem 14*b* projecting rearwardly into the member 12 for carriage by the latter. Element 14 typically may consist of metal, and is carried to move forwardly under increased pressure exerted by forwardly expanding freezing hydraulic fluid in annular space 15 between 10 and 12, as in closed FIG. 1 position of the valve. At that time, O-ring 13*a* slidably seals against bore 16 of plastic tubular part 10*b*. Since that seal is a sliding seal, variation in such fluid pressure, normally about 60 psi, does not affect such closure.

When a control means, such as valve handle 18 is rotated in one direction, for example counter-clockwise, the sealing O-ring 13*a* backs away, i.e. leftwardly, from the bore 16, as in FIG. 2, allowing pressurized water to flow leftwardly from inlet tubing 21 past the element 14 and the O-ring, defining a flow port 100 to flow to the outlet tubing at 20 carried by body 19, as for delivery from a building or residence. A residence wall is indicated at 17, in FIG. 2, and engaged by body flange 19*a*. When handle 18 is rotated clockwise, inner member 12 moves rightwardly to advance closure means 13 to FIG. 1 "OFF" position.

Handle 18 has connection to a threaded metallic tube 22 that carries the leftward end of inner tubing 12. Tube 22 has threaded connection at 23 to a fitting 24, that in turn connects to the body 19. The rightward end of body part 19*b* carries the outer tubular metallic or extruded plastic member 10, as shown by coupling 25. An external stop shoulder 26 on fitting 24 limits rightward travel of the rotated handle, tube 22 and inner tubing 12, in FIG. 1 position; and an internal stop shoulder 27 on the fitting 24 limits leftward travel of 22 and 12 in response to opposite direction rotated travel of the handle and tubing 12, in FIG. 2. An abutment 30 on tube 22 engages shoulder 27. Note that tube 12 is rotated by the handle, to rotate seal 13*a*, as it advances or retreats in bore 11, to aid such seal formation.

As will be seen, a second fluid port, i.e. a side port, as for example at 101, in tube 22, is located sidewardly of the inner tubular member to pass escape fluid in relatively retracted position of the inner member to redundantly relieve fluid pressure in space 15 within 12, the inner member being elongated and extending lengthwise in said outer tubular member. Relief of pressure that might damage the hydrant, in the first instance is provided by rightward expansion or travel of plug or bullet 14 and seal 13*a*, in the bore of 11. Fluid in space 15 accesses space 15*a* via clearances between stem 14*b* and bullet 14, and between 14*b* and the bore 12*b* of member 12, when bullet 14 moves forwardly to disengage the end of 12.

Figure 3:
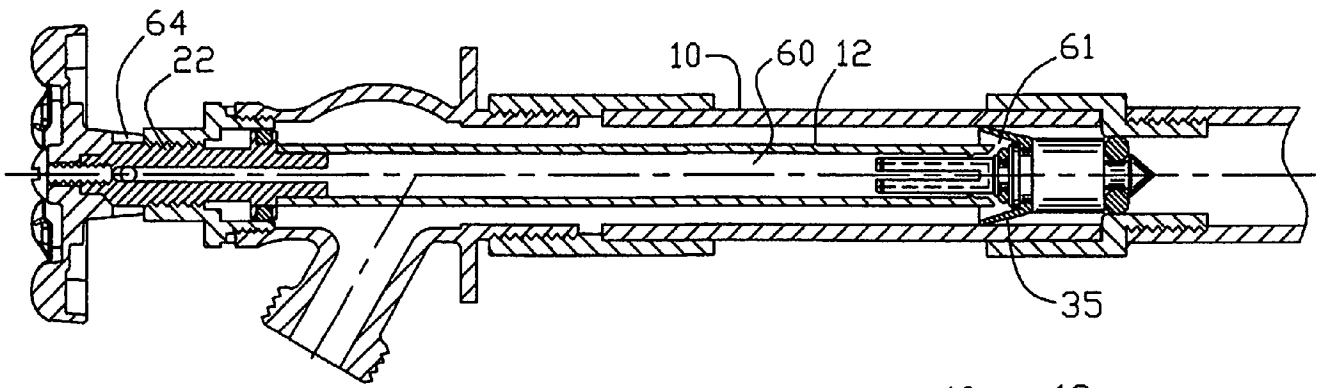
FIG. 3 is a section showing water pressure release through the bore of the inner tubular member.
Figure 4:
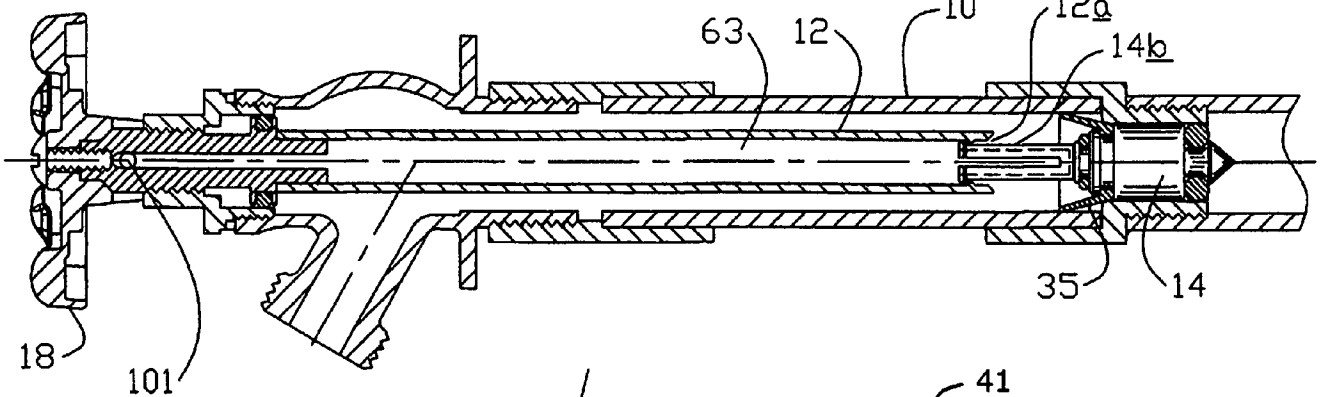
FIG. 4 is like FIG. 3 but showing sealing position of a relatively slidable sealing element.

FIGS. 3 and 4 are similar to FIGS. 1 and 2, but show pressurized fluid flow into the interior 60 of inner tubular member 12, via a gap 61 between the end 12*a* of member 12 and the stem 14*b*. Such fluid can escape to the exterior via axial passage 63 within member 12, and a radial outlet 101 in tube 22, proximate handle 18.

Figure 5:
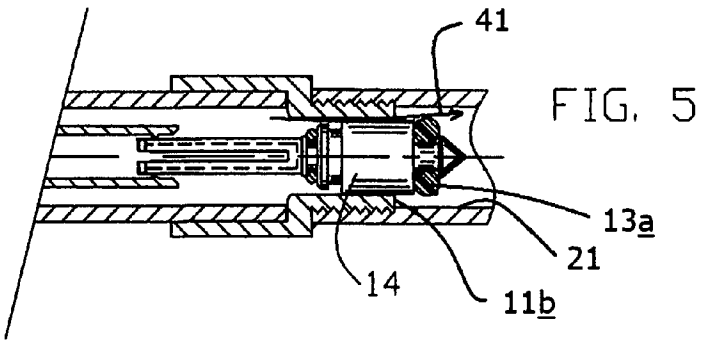
FIG. 5 is a fragmented section showing modified elements in advanced position of the slidable sealing element.

FIG. 5 shows a modification for further pressurized fluid flow 41 into inlet tubing 21 when O-ring 13*a* moves past shoulder 11*b* of bore 11.

Of importance, as an added feature of the invention, is the ability to mold the left end portion of plastic member 10 into position in metallic tubular connector 25, or equivalent metallic support structure, for example 19*b*, to simplify and reduce cost of fabrication.

In the above, both the inner and outer tubular members may consist of extruded plastic material, or of metal.

FIGS. 1-4 also show provision of an elastomeric cup seal 35 carried by the element 14, and which spreads or diverges conically, rearwardly, in FIG. 4, so that is outer lip 35*a* engages the bore of outer plastic member 10 as O-ring 13*a* retracts into the bore 10*b*. The skirt of the seal is collapsed against bore 10*b* as seal 13*a* protrudes beyond 10*b*.

What is claimed is:

1. In a hydrant assembly, the combination comprising a) an outer tubular member having a first flow port, b) an inner tubular member having closure means thereon to close said port in relatively axially advanced position of said closure means, and to open said port in relatively axially retracted position of said closure means that allows fluid flow through said port to an outlet from said outer tubular member, c) control means to control relative movement of the inner and outer members, and d) said closure means comprising an annular first seal extending about an axis defined by said closure means, there being an axially elongated primary bore carried by said outer member, and into which said first seal has sliding sealing fit as the closure means is advanced, and wherein the closure means remains slidable in said primary bore in spacially advanced positions of the first seal relative to said primary bore, e) there being a stem projecting from said closure means for slidable reception into the forward end of said inner tubular member, f) there being an annular cup seal carried by the closure means to have peripheral sliding engagement with a secondary bore defined by the outer tubular member as the stem slides in said inner tubular member and as the first seal slides in said primary bore, which is stepped inwardly relative to the secondary bore, there being an elongated body between said first seal and said cup seal.

2. The combination of claim 1 including a second port located sidewardly of the outer member to pass fluid from space between the members, to relieve fluid pressure build-up under freeze conditions.

3. The combination of claim 1 including a hollow valve body carrying said members, and an adjustment handle carried by said body to adjust said inner member between relatively endwise advanced and retracted positions.

4. The combination of claim 3 wherein said members are longitudinally elongated, and said handle is located remotely from said closure means.

5. The combination of claim 3 wherein said members are endwise elongated, and the outer member consists of plastic material and extends endwise between the handle and said port.

6. The combination of claim 1 wherein major length of the inner member consists of plastic material.

7. The combination of claim 6 wherein said hollow valve body is metallic and endwise supports said plastic tubular member.

8. The combination of claim 7 wherein said elongated body defines a sealing plug carried by said closure means adjacent the first seal to seal off against said primary bore carried by the outer tubular member during establishing of said sliding sealing fit.

9. The combination of claim 1 wherein an O-ring seal is captivated between axially spaced flanges carried by said stem for axial movement between said flanges.

10. The combination of claim 1 wherein said cup seal is axially bodily movable and is positioned about the axis of the inner member to pass fluid flow from said port and to space defined between said members, and to block reverse fluid flow from said space and through said first port in said inner member relatively retracted position.

11. In a hydrant assembly, the combination comprising a) an outer tubular member having a first flow port, b) an inner tubular member having closure means thereon to close said port in relatively axially advanced position of said closure means, and to open said port in relatively axially retracted position of said closure means that allows fluid flow through said port to an outlet from said outer tubular member, c) control means to control relative movement of the inner and outer members, and d) said closure means comprising an annular first seal extending about an axis defined by said closure means, there being an axially elongated primary bore carried by said outer member, and into which said first seal has sliding sealing fit as the closure means is advanced, e) and wherein the closure means has an extended position in which the first seal is forwardly spaced from and outside said primary bore.

* * * * *